US009905950B2

(12) United States Patent
Marsh et al.

(10) Patent No.: US 9,905,950 B2
(45) Date of Patent: Feb. 27, 2018

(54) ELECTRIC CONTACT MEANS AND ELECTRICAL CABLE ASSEMBLY FOR THE AUTOMOTIVE INDUSTRY

(71) Applicants: TE Connectivity Germany GmbH, Bensheim (DE); Tyco Electronics UK Ltd, Wiltshire (GB)

(72) Inventors: John Marsh, London (GB); Michael Schambach, Dortmund (DE); Ruediger Meier, Neckargemuend (DE); Jochen Fertig, Bensheim (DE); Holger Stange, Frankenthal (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/008,939

(22) Filed: Jan. 28, 2016

(65) Prior Publication Data

US 2016/0226170 A1 Aug. 4, 2016

(30) Foreign Application Priority Data

Jan. 30, 2015 (EP) ..... 15153319

(51) Int. Cl.

| | |
|---|---|
| ***H01R 13/11*** | (2006.01) |
| ***H01R 13/02*** | (2006.01) |
| ***H01R 13/24*** | (2006.01) |
| ***H01R 4/02*** | (2006.01) |
| ***H01R 4/10*** | (2006.01) |
| ***H01R 4/48*** | (2006.01) |

(Continued)

(52) U.S. Cl.

CPC ..... *H01R 13/02* (2013.01); *H01R 4/029* (2013.01); *H01R 4/10* (2013.01); *H01R 4/4809* (2013.01); *H01R 4/58* (2013.01); *H01R 13/113* (2013.01); *H01R 13/2457* (2013.01); *H01R 4/183* (2013.01); *H01R 2201/26* (2013.01)

(58) Field of Classification Search

CPC .... H01R 13/113; H01R 13/11; H01R 13/187; H01R 13/112; H01R 13/193; H01R 4/185; H01R 4/188; H01R 4/20; H01R 43/16; H01R 43/058

USPC ..... 439/852, 851, 850, 856, 857, 877

See application file for complete search history.

(56) References Cited

U.S. PATENT DOCUMENTS 4,820,169 A * 4/1989 Weber ..... H01R 23/68 439/65
5,116,237 A * 5/1992 Loewen ..... H01R 12/83 29/845

(Continued)

FOREIGN PATENT DOCUMENTS

JP 2002100430 A * 4/2002
JP 2011044256 A * 3/2011

(Continued)

OTHER PUBLICATIONS

Extended European Search Report, Application No. 15153319.7, dated Jul. 24, 2015, 5 pages.

*Primary Examiner* — Abdullah Riyami
*Assistant Examiner* — Vladimir Imas
(74) *Attorney, Agent, or Firm* — Barley Snyder

(57) ABSTRACT

An electric contact is disclosed. The electric contact has an electric contact section including a plurality of contact springs with different geometrical shapes and a connecting section connected to an electric conductor.

31 Claims, 3 Drawing Sheets

(51) Int. Cl.
*H01R 4/58* (2006.01)
*H01R 4/18* (2006.01)

(56) References Cited

U.S. PATENT DOCUMENTS 5,269,712 A * 12/1993 Denlinger ..... H01R 43/16 439/845
5,564,952 A * 10/1996 Davis ..... H01R 13/113 439/682
5,582,519 A * 12/1996 Buchter ..... H01R 23/688 439/101
5,890,936 A * 4/1999 McDonald ..... H01R 13/114 439/852
6,062,919 A * 5/2000 Trafton ..... H01R 13/187 439/843
6,086,425 A * 7/2000 Lescoat ..... G06K 7/0021 235/441
6,264,509 B1 * 7/2001 Kwang ..... H01R 13/113 439/852
6,382,999 B1 * 5/2002 Mou ..... H01R 13/6485 439/181
6,875,063 B2 * 4/2005 Zhao ..... H01R 13/187 439/787
6,926,536 B2 * 8/2005 Ochiai ..... H01R 13/2492 439/591
7,059,921 B2 * 6/2006 Mulot ..... H01R 43/16 439/852
7,150,660 B2 * 12/2006 Allgood ..... H01R 11/289 439/845
7,185,430 B2 * 3/2007 Ochiai ..... H01R 43/16 29/874
7,387,548 B2 * 6/2008 Takehara ..... H01R 13/187 439/843
7,438,559 B2 * 10/2008 Ryu ..... H01R 13/2428 439/66
7,695,295 B2 * 4/2010 Hanyu ..... H01R 12/774 439/108
8,096,843 B2 * 1/2012 Gong ..... H01R 12/585 439/856
8,128,441 B2 * 3/2012 Mukuno ..... H01R 13/055 439/845
8,366,497 B2 * 2/2013 Glick ..... H01R 9/245 439/839
8,403,707 B2 * 3/2013 Tai ..... H01R 13/434 439/397
8,419,486 B2 * 4/2013 Tyler ..... H01R 13/113 439/842
8,668,531 B2 * 3/2014 Yamaguchi ..... H01R 13/187 439/843
8,764,497 B2 * 7/2014 Fehling ..... H01R 11/05 439/629
8,944,831 B2 * 2/2015 Stoner ..... 439/108
8,992,270 B2 * 3/2015 Glick ..... H01R 13/18 439/839
9,017,116 B2 * 4/2015 Ando ..... H01R 13/113 439/862
9,054,470 B2 * 6/2015 YuQiang ..... H01R 12/724
9,070,990 B2 * 6/2015 Flickinger ..... H01R 4/48
2007/0066152 A1 3/2007 Mohs et al.
2011/0045712 A1 * 2/2011 Mukuno ..... H01R 4/4881 439/845
2013/0244504 A1 * 9/2013 Ogura ..... H01R 13/11 439/759
2013/0273756 A1 * 10/2013 Stoner ..... H01R 13/658 439/108
2014/0295680 A1 * 10/2014 YuQiang ..... H01R 12/724 439/55
2015/0325937 A1 * 11/2015 Mikage ..... H05K 3/321 439/493

FOREIGN PATENT DOCUMENTS

WO 2012176394 A1 12/2012
WO 2012176395 A1 12/2012

* cited by examiner

ELECTRIC CONTACT MEANS AND ELECTRICAL CABLE ASSEMBLY FOR THE AUTOMOTIVE INDUSTRY

CROSS-REFERENCE TO RELATED APPLICATIONS

This application claims the benefit of the filing date under 35 U.S.C. § 119(a)-(d) of European Application No. 15153319.7, filed Jan. 30, 2015.

FIELD OF THE INVENTION

The present invention relates to an electric contact, and more particularly, to a socket or plug contact.

BACKGROUND

A large number of electric connections, particularly electrical plug connections, are known which serve to transmit electric currents, voltages and/or signals with a largest possible bandwidth. Particularly in the automotive industry, such connections must safeguard a faultless transmission of electric power, signals and/or data in thermally charged, polluted, moist or chemically aggressive surroundings.

Due to a wide range of applications for such connections, a large number of specifically configured electric plug contacts are known, particularly crimp-contacts. In the field of electrical power contacting for the automotive industry, aside from a crimp-contact, only circular high-voltage or high-current contacts are known which could easily be stamped out of milled metal strips. In a rectangular high-voltage or high-current contact, an electric contact is provided by many filigree contact lamellas, wherein all contact lamellas have the same design and are bound to a contact cage at both longitudinal end portions. Due to the position of the contact lamellas in the contact, an amperage varies per contact lamella; a balanced current distribution is not possible with such a contact. Furthermore, the many filigree contact lamellas lead to a non-robust, damageable contact.

A known contact comprises identical contact lamellas wherein some contact lamellas are located more closely to a conductor-crimping section of the contact than several other contact lamellas. When using the contact, because the current always takes the path of least resistance, this leads to the problem that the contact lamellas which are located more closely to the conductor-crimping section carry more electric current than those which are located further away from the conductor-crimping section. The contact lamella located closest to the conductor-crimping section carries the most current and the one furthest away from the conductor-crimping section only carries a very small amount or hardly any current.

SUMMARY

An object of the present invention, among others, is to provide a robust electric contact with a balanced current distribution. The disclosed electric contact has an electric contact section including a plurality of contact springs with different geometrical shapes and a connecting section connected to an electric conductor.

BRIEF DESCRIPTION OF THE DRAWINGS

The invention will now be described by way of example with reference to the accompanying figures, of which.

DETAILED DESCRIPTION OF EMBODIMENT(S)

The present invention in the following will be described in more detail in conjunction with embodiments of an electric contact 1. The contact 1 may be a contact for transmitting electrical power, such as via a copper or aluminium cable, and may be used in the automotive industry. However, the invention is not limited to such embodiments, but may be applied as defined by the invention to all contacts and all conductor materials. These embodiments are provided so that this disclosure will be thorough and complete and still fully convey the scope of the invention to those skilled in the art.

The electrical contact 1 of the present invention will be described with reference to FIGS. 1-5. The electrical contact 1 includes a contact section 10, a mechanical transitional section 20, and a connecting section 30. The major components of the invention will now be described in greater detail.

Figure 1:
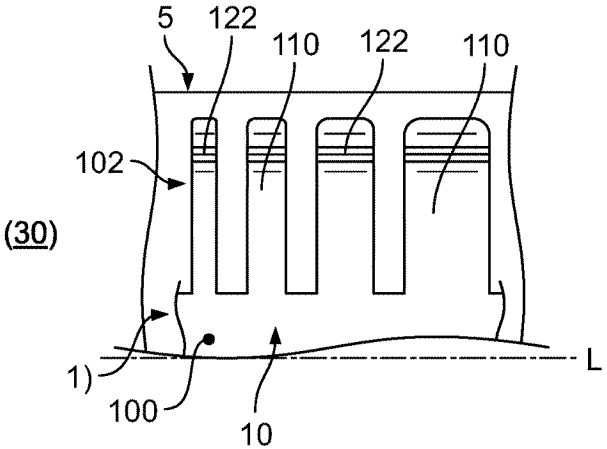
FIG. 1 is a top view of a contact section of an electric contact according to a first embodiment of the invention.

FIG. 1 shows the first embodiment of a contact section 10 having four contact springs 110 equally distanced from one another and all having approximately the same length. Of course, it is possible to apply less or more than four equally distanced contact springs 110 in the contact section 10. Here, the contact springs 110 of the contact section 10 are all bound to only one side of the contact body 100. The contact body 100, for example as a partial body 100 of the contact 1, may be configured as an spring contact body 100, a contact retainer 100, a contact cage 100, a receptacle 100, or other bodies known to those with ordinary skill in the art. In the following, such a configuration with contact springs 110 fixed to only one side of the contact body 100 is also referred to as an arrangement 102 of contact springs 110.

As shown in FIG. 1, the contact springs 110 are robust by having different widths, while the lengths and the thicknesses of the contact springs 110 remain equal. Compensation of the contact normal forces may herein be implemented by the widths of the contact springs 110; as a contact normal force of a contact spring 110 becomes lower, its width may be increased a little more, or as a contact normal force of a contact spring 110 becomes higher, its width may be increased a little less than explained in the following. This may alternatively or additionally also be carried out by different distances between the contact springs 110. The contact springs 110 have contact areas 122. The contact areas 122 may, for example, be a contact protrusion 122, projection 122, corrugation 122 etc., of the contact spring 110.

Figure 2:
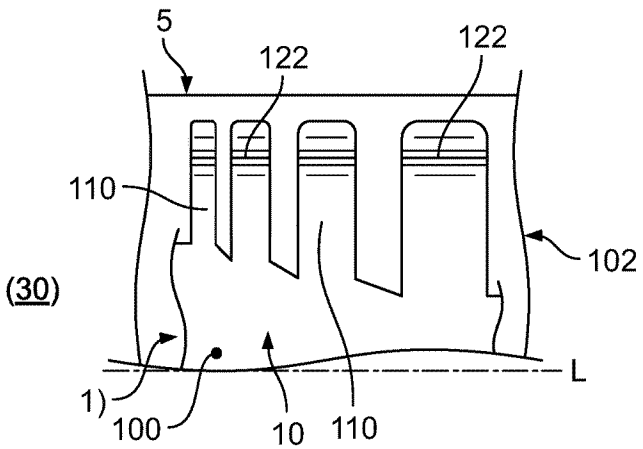
FIG. 2 is a top view of a contact section of an electric contact according to a second embodiment of the invention.

FIG. 2 represents a second embodiment of the invention of the contact section 10 also having four contact springs 110 each with different widths. In the second embodiment, however, the contact springs 110 are not equally distanced from one another and do not have the same approximate lengths. The different lengths of the contact springs 110 may be carried out by increasing an area of the contact body 100 in a middle area of the contact section 10 in comparison to FIG. 1, wherein the tip ends of the contact springs 110 may be arranged in a straight line which may be parallel to an edge of the counter-contact 5. Further, the middle area of the contact section 10 may be approximately rectangular, wherein the tip ends of the contact springs 110 may be arranged in a straight or in a curved line which may be angled with respect to the edge of the counter-contact 5.

Figure 3:
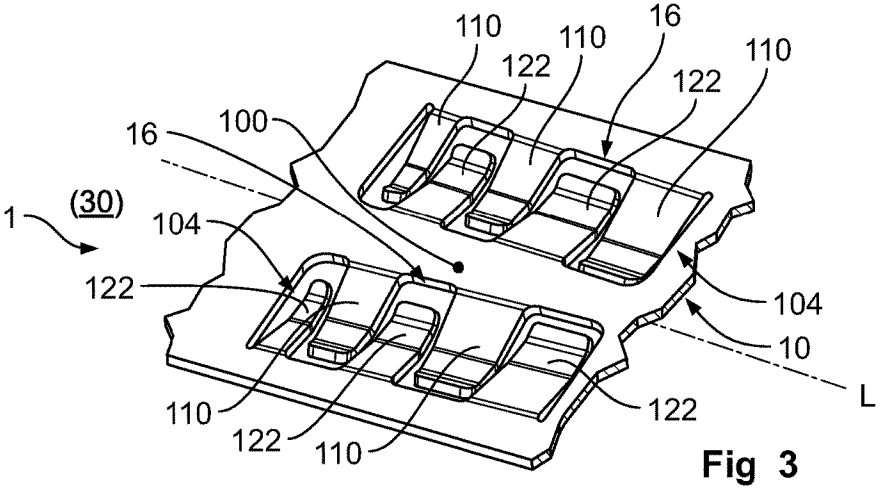
FIG. 3 is a perspective view of a contact section of the electric contact according to a third embodiment of the invention.

In order to not excessively weaken a rigidness of the contact section 10 due to the optionally stamped-out contact springs 110, the contact springs 110 may be arranged in an alternatingly opposite manner in an open inner frame 16 of the contact section 10, as shown in FIG. 3. This for example means that in a longitudinal direction L of the contact 1, one contact spring 110 is connected to a side of the contact section 10 which is located more to the right (or more to the left, respectively), whereas the contact spring 110 which in longitudinal direction L is optionally positioned directly adjacent is then connected to an opposite side of the contact section 10; located more to the left (or more to the right, respectively).

As a result, the contact springs 110 arranged opposite to each other in a portion of the contact section 10 interlock or engage. Here, each side with the respective contact springs 110 constitutes an arrangement 102 of contact springs 110 wherein these two arrangements 102 intermesh and thereby constitute an array 104 of contact springs 110 shown in FIG. 3. One of the two arrangements 102 in a single array 104 may comprise one more contact spring 110 than the directly opposite and adjacent arrangement 102 of this array 104. If for example two arrays 104, 104 are provided in a layer 12, 14 as in FIG. 4 of the contact section 10, the two inner sides of the two arrays 104 may comprise one contact spring 110 less than the two outer sides of the two arrays 104. Of course, this may be carried out in a converse manner, as would be appreciated by one with ordinary skill in the art.

An inventive configuration of two arrays 104, 104 (or for example four arrangements 102, 102; 102, 102) of contact springs 110 in the contact section 10 is shown in FIG. 3, depicting the third embodiment of the invention. In a portion of the contact section 10, contact springs 110 having smaller widths are provided in the proximity of the connecting section 30 (not shown in FIG. 3 but indicated by the reference numeral in brackets). Contact springs 110 having larger widths are arranged further away from the connecting section 30. The contact springs 110 and/or their contact areas 122 become wider with an increasing distance from the connecting section 30. This may analogously be applied to the lengths of the contact springs 110.

The electrical contact 1 may have a straight, angled, or curved configuration, and may be configured as a crimp-contact 1. The contact 1 may alternatively be an electro- or ultrasonic-welding contact 1. The contact 1 may be configured as a female-, socket- or plug-contact, a receptacle, a plug-in sleeve, a coupling, or other contacts known to those with ordinary skill in the art. The contact 1 may have a closed configuration in several parts, in one piece, in one material piece or in an integral form optionally made from a metal or metal alloy. The contact springs 110 may be directly stamped into an electric contact body 100 of the contact 1.

Furthermore, the contact 1 comprises an electric and mechanical connecting section 30 for an electric conductor 2 of the electrical cable, and optionally a mechanical fastening section (not shown) for an electrical isolation (not shown) and, if suitable, for the conductor 2 of the cable. The electrical cable, wire, or conductor 2 provided with the inventive contact 1 may further be referred to as a cable assembly, a pre-assembled or ready-made cable, or an electrical wiring harness.

Figure 4:
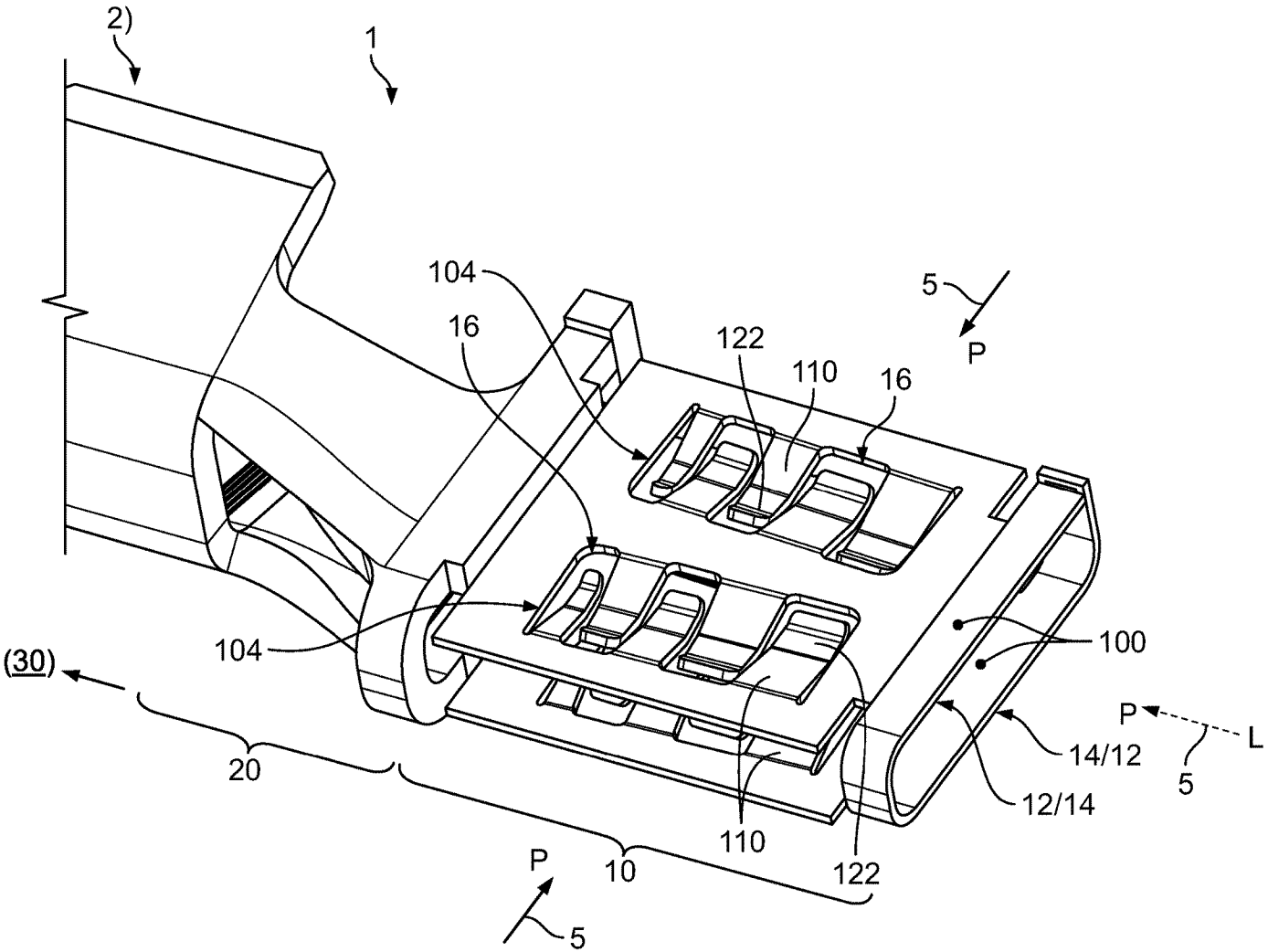
FIG. 4 is a perspective view of a contact section of an electric contact according to a fourth embodiment of the invention.
Figure 5:
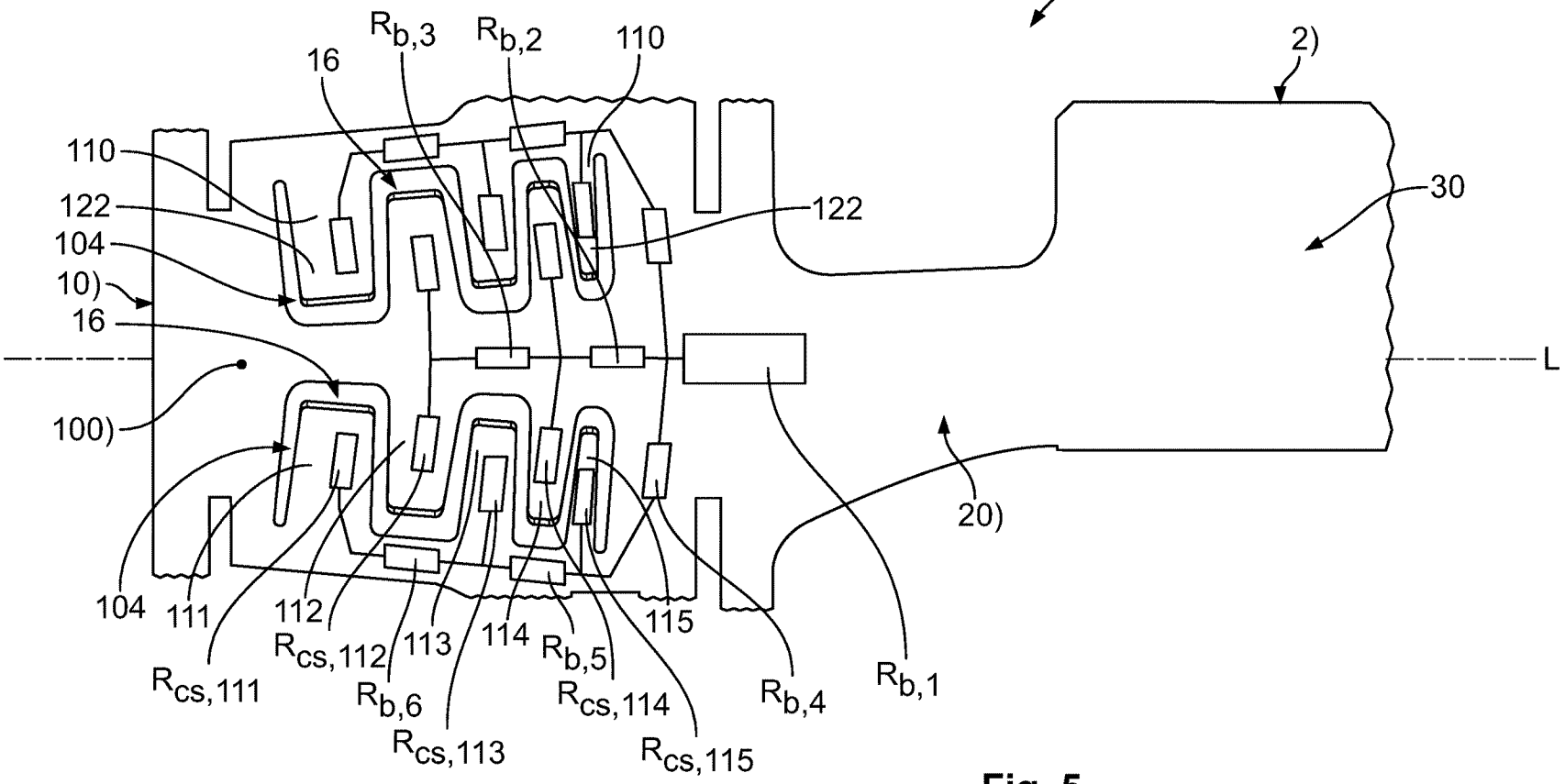
FIG. 5 is a top view of the contact section of FIG. 4, wherein electric resistivities of contact springs and electric resistivities of their corresponding bulks have been schematically indicated.

In the exemplary contact 1 of FIGS. 4 and 5 the connecting section 30 and the fastening section are designed as crimping sections; the connecting section 30 is designed as a conductor-crimping section 30 and the fastening section is designed as an isolation-crimping section. A mechanical transitional section 20 is between the contact section 10 and the connecting section 30, and between the contact section 30 and the fastening section, a mechanical transitional section is optionally arranged which separates crimping lugs or wings of the conductor 30 and the isolation-crimping section. The electric conductor 2 of the electrical cable may further be an electric (litz) wire, lead, strand, flex, cord etc. mechanically clamped, crimped, brazed, soldered, compacted, welded etc. on/at the connecting section 30 of the contact 1.

A counter-contact 5, as shown in FIGS. 1 and 2, may be made from a milled metal strip. The counter-contact 5 may be designed in an analogous manner to the contact 1. In this context, the counter-contact 5 may be configured as a tab-5 or pin-contact 5, a fast-on tab 5, a flat plug 5, or other types of contacts known to those with ordinary skill in the art.

The contact 1 is configured for being plugged together with the electric counter-contact 5, as shown in FIGS. 1 and 2. The electric and mechanical contact section 10 of the contact 1 is plugged together with the contact-section of the counter-contact 5, wherein the respective contact springs 110 are provided for mechanically contacting the counter-contact 5.

In order to obtain a balanced current distribution through the contact section 10 to the connecting section 30 and in the connecting section 30 to the herein electrically connected electric conductor 2, according to the invention, a total electric resistance R has to be equalized for some or all electric contact springs 110. This may be done with different materials and/or a different geometry of the contact section 10 and/or the contact springs 110. The geometries, particularly a width and/or a length, of the respective contact springs 110 are adapted among themselves according to their position in the contact section 10 with regard to the connecting section 30.

Since a contact spring 110 with a smaller width has a higher electric resistivity $R_{cs}$ than a contact spring 110 with a larger width, the cross sections of the contact springs 110 in the contact section 10 are inventively adapted. According to the invention, contact springs 110 with smaller widths are located comparatively closely to the connecting section 30, and contact springs 110 with larger widths are located comparatively far away from the connecting section 30.

Further, a contact normal force of a contact spring 110 on the counter-contact 5 may have a significant influence on how much current may flow through such a (point or area) connection. Therefore, the lengths of the contact springs 110 may also be adapted. Here, a contact spring 110 with a smaller width has a lower contact normal force than a contact spring 110 with a larger width, so the length of a contact spring 110 with a larger width may be increased in order to obtain constant normal forces for the respective contact springs 110. According to the invention, contact springs 110 with shorter lengths may be provided which are located comparatively closely to the connecting section 30, and contact springs 110 with longer lengths are provided which are located comparatively far away from the connecting section 30. Herein, the contact springs 110 with shorter lengths also have smaller widths, whereas the contact springs 110 with longer lengths also have larger widths.

The closer a contact spring 110 is to the connection section 30, the smaller and the shorter the contact spring 110. The farther away a contact spring 110 is from the connection section 30, the wider and the larger the contact spring 110. Here, each contact spring 110 is particularly designed in a way that a bulk resistivity $R_b$ along an electrical path is equalized over the contact section 10 or a part of or the whole contact 1 by a resistivity $R_{cs}$ of the respective contact spring 110.

In general, a shape of a contact spring 110 is arbitrary. For example, a contact spring 110 may be i-shaped, v-shaped or u-shaped (filled). The contact spring 110 may be the shape of a tongue, an arm, a lamella, a nose, a strip, a bar or a rod. Here, a horizontal, a vertical and/or an elevation projection of a contact spring 110 or a distribution of a horizontal, a vertical and/or an elevation projection of a contact spring 110 is arbitrary; the distribution of a cross section or profile of the respective contact spring 110 may be chosen in accordance with the functions mentioned herein. Respectively, two or more contact springs 110 having similar positions in the contact section 10 with regard to the connection section 30, i.e. having identical bulk resistivities $R_b$ in the contact 1 or its contact body 100, may be constructed in a geometrically identical manner having identical contact spring resistivities $R_{cs}$.

According to the invention, the electric resistivity $R_{cs}$ of the respective contact spring 110 is particularly adjusted between an electric and mechanical contact area 122 and its connection or junction to the contact body 100. An amount of material and its geometry between the contact area 122 and the connection of the contact spring 110 to the contact body 100 determines the electric resistivity $R_{cs}$ for the contact spring 110 itself; i.e. the material of the contact spring 110 aside/on the off-side of the residual contact body 100.

This electric resistivity $R_{cs}$ is adjusted taking an electrical resistivity $R_{b,n}$ of a corresponding bulk n=1 to 6 or the electrical resistivities $R_{b,n}$, . . . of the corresponding bulks n=1 to 6 of the contact body 100 and/or the connection section 30 into account, as shown in FIG. 5. According to the invention, the determined electric resistivity $R_{cs}$ for a contact spring 110 due to their position (corresponding bulk n=1 to 6 or bulks n=1 to 6) in the contact body 100, conversely determines the amount of material and a geometry between the contact area 122 and the connection of the contact spring 110 to the contact body 100, i.e. a form of the contact spring 110. This relates to a contact spring 110 which is connected to the contact body 100 in its longitudinal direction at one side to the contact body 100. If a contact spring 110 is for example designed as a contact lamella 110, i.e. if it is connected to the contact body 100 in its longitudinal direction at two sides of the contact body 100, according to the invention this has to be carried out for both branches of the contact lamella 110.

In the shown embodiments of the invention, each contact spring 110 is provided at only one side of the contact body 100, particularly in an integral configuration or in one material piece with the contact 1. According to the invention, contact springs 110, are configured and installed in the contact body 100 in such a way that no primarily preferred path exists for the current which may flow through the contact springs 110. All current paths through the respective contact spring 110 and away from this contact spring 110 should be approximately equally 'attractive' for the current.

Since contact springs 110 with smaller widths have higher electric resistivities ($R_{cs}$) the widths of the contact springs 110 according to the invention are set or selected in such a way that, when taking into account that a current flows through the contact body 10 and/or the contact 1, the total electric resistance $R=R_{cs}+R_b$ of the respective contact spring 110 (index cs) and its corresponding bulk (index b) or bulks (index b) are approximately equal for all contact springs 110. Furthermore, since contact springs 110 with larger widths have higher contact normal forces, their lengths may be increased in order to generate consistent contact normal forces by all contact springs 110 which may be pressed onto the counter-contact 5.

On the one hand, the widths of the contact springs 110 increase continuously starting close to the connecting section 30 of the contact body 100 along the longitudinal direction L of the contact 1; the further away the contact spring 110 in question is from the connecting section 30, the wider is its configuration. On the other hand, the lengths of the contact springs 110 may increase continuously starting close to the connecting section 30 of the contact body 100 along the longitudinal direction L of the contact 1; the further away the contact spring 110 in question is from the connecting section 30, the longer is its configuration. This may analogously be applied to the widths and/or lengths of the contact springs 110 between their respective contact areas 122 and their respective connections or junctions to the contact body 100.

The fourth embodiment of the inventive contact body 100, the inventive contact section 10 and/or the inventive contact 1 which may be configured as a crimp contact 1 is depicted in FIGS. 4 and 5. The contact body 100 may be configured as a contact retainer 100 comprising an upper 12 and a lower layer 14 constituting the contact section 10. The contact body 100 may accept counter-contact 5 in a 90°- and/or 270°-direction. Plug directions P, connection directions P or orientations P are indicated by an arrow having a continuous line in FIG. 4. Furthermore, the contact body 100 may be configured in such a way that the counter-contact 5 may be plugged in a 0°-direction (this plug direction P is indicated by an arrow with a dashed line in FIG. 4). Other contact bodies 100 are applicable which may allow for different plug directions P (not shown).

Each layer 12, 14 of the contact retainer 100 shown in FIG. 4 comprises at least one arrangement 102 of contact springs 110. Each layer 12, 14 may also comprise at least one array 104 of contact springs 110. Each layer 12, 14 particularly comprises two arrays 104, 104) of contact springs 110, arranged side by side. FIGS. 4 and 5 presently show five contact springs 110 in each array 104, wherein each array 104 is composed of two arrangements 102 and wherein one arrangement 102 comprises two (inner longitudinal side of the respective inner frame 16, 16) and the complementary arrangement 102 of this array 104 comprises three contact springs 110 (outer longitudinal side of the respective inner frame 16, 16). As would be appreciated by one with ordinary skill in the art, the number of contact springs 100 could vary.

Those contact springs 110 of the arrangements 102, 102; 102, 102 or arrays 104, 104 having similar positions in the contact section 10 have approximately the same geometries, i.e. the same width, the same length and the same thickness. This presently applies to the contact springs 110 having nearly identical longitudinal positions in the contact section 10. According to FIG. 4, four contact springs 110 of the twenty contact springs 110 of the contact section 10 respectively have similar positions in the contact section 10. These positions are characterized by approximately identical bulk resistivities $R_b$; the lengths of the corresponding bulk or bulks of these four contact springs 110 are optionally approximately identical and may comprise an approximately identic geometry.

FIG. 5 illustrates the electric resistivities $R_{cs,m}$ of the respective contact springs 110, m (m=pos. 111 to 115) and the electric resistivities $R_{b,n}$ of the corresponding bulk n or bulks n (n=pos. 1 to 6). The inventive equivalent total resistances R for each possible way of the current which may flow through the contact section 10 and into the connecting section 30 are as follows:

$$R=/\approx R_{cs,111}+R_{b,6}+R_{b,5}+R_{b,4}+R_{b,1}=/\approx$$

$$=/\approx R_{cs,112}+R_{b,3}+R_{b,2}+R_{b,1}=/\approx$$

$$=/\approx R_{cs,113}+R_{b,5}+R_{b,4}+R_{b,1}=/\approx$$

$$=/\approx R_{cs,114}+R_{b,2}+R_{b,1}=/\approx$$

$$=/\approx R_{cs,115}+R_{b,4}+R_{b,1}=/\approx R.$$

According to this system of equations and with given bulk resistances $R_{b,n}$; $R_{b,1}$, $R_{b,2}$, $R_{b,3}$, $R_{b,4}$, $R_{b,5}$, $R_{b,6}$, for each contact spring 110; 111, 112, 113, 114, 115, the inventively required electric resistivities $R_{cs,m}$; $R_{cs,111}$, $R_{cs,112}$, $R_{cs,113}$, $R_{cs,114}$, $R_{cs,115}$ may be calculated. Furthermore, a geometry of the respective contact spring 110; 111, 112, 113, 114, 115 may be calculated and chosen from the calculated electric resistivities $R_{cs,m}$; $R_{cs,111}$, $R_{cs,112}$, $R_{cs,113}$, $R_{cs,114}$, $R_{cs,115}$.

The electric resistance of a contact spring 110, m is given as follows:

$$R_{cs,m}=(\rho\cdot l_{cs,m}/A_{cs,m},$$

ρ being a specific electric resistance of the material of the contact 1, $l_{cs,m}$ being a (medium) length of the respective contact spring 110; 111, 112, 113, 114, 115, and $A_{cs,m}$ being a (medium) cross section of the respective contact spring 110; 111, 112, 113, 114, 115.

Since a material thickness of the contact 1 is at least partially equal, an adaption of a geometry of the respective contact spring 110; 111, 112, 113, 114, 115 may be accomplished by an adaption of the width of the respective contact spring 110; 111, 112, 113, 114, 115. Further, according to the formula for the electric resistance $R_{cs}$,m of a contact spring 110, m, an electric resistance $R_{b,n}$; $R_{b,1}$, $R_{b,2}$, $R_{b,3}$, $R_{b,4}$, $R_{b,5}$, $R_{b,6}$ for the bulks n (n=pos. 1 to 6) may also be estimated or calculated.

What is claimed is:

1. An electric contact, comprising:

an electric contact section having a plurality of contact springs with different geometrical shapes mechanically contacting a same counter-contact, at least one contact spring of the plurality of contact springs having a smaller width than another contact spring, a total electric resistivity of a path through each of the plurality of contact springs is equal or approximately equal and is a sum of a respective contact spring electrical resistivity and a corresponding bulk electrical resistivity; and a connecting section connected to an electric conductor, the at least one contact spring having a smaller width positioned closer to the connecting section.

2. The electric contact of claim 1, wherein at least one contact spring has a shorter length than another contact spring.

3. The electric contact of claim 2, wherein the at least one contact spring having a shorter length is positioned closer to the connecting section.

4. The electric contact of claim 3, wherein the at least one contact spring having a shorter length also has a smaller width than another contact spring.

5. The electric contact of claim 1, wherein the plurality of contact springs are positioned consecutively in the contact section.

6. The electric contact of claim 5, wherein the lengths of the contact springs decrease in a direction towards the connecting section.

7. The electric contact of claim 5, wherein the widths of the contact springs decrease in a direction towards the connecting section.

8. The electric contact of claim 1, wherein the plurality of contact springs is positioned in an intermeshing arrangement.

9. The electric contact of claim 1, wherein the electric contact section further comprises a contact body to which the plurality of contact springs are attached.

10. The electric contact of claim 9, wherein the contact body accepts the counter-contact in a plurality of directions.

11. The electric contact of claim 10, wherein the plurality of contact springs is arranged in opposite layers of the contact body.

12. The electric contact of claim 11, wherein each layer has two intermeshed arrays of contact springs.

13. The electric contact of claim 12, wherein an intermeshed array of one layer is flush with an intermeshed array of the opposite layer.

14. The electric contact of claim 13, wherein an intermeshed array has at least three contact springs.

15. The electric contact of claim 14, wherein one side of an intermeshed array has one more contact spring than the other side of the intermeshed array.

16. The electric contact of claim 1, wherein at least one contact spring is configured as a contact lamella.

17. An electrical cable assembly, comprising:

an electrical cable; and an electric contact having a plurality of contact springs with different geometrical shapes mechanically contacting a same counter-contact and a connecting section connected to the electrical cable, at least one contact spring of the plurality of contact springs having a smaller width than another contact spring and positioned closer to the connecting section, a total electric resistivity of a path through each of the plurality of contact springs is equal or approximately equal.

18. The electrical cable assembly of claim 17, wherein the electric contact is formed of a plurality of parts.

19. The electrical cable assembly of claim 17, wherein the electric contact is integrally formed.

20. The electrical cable assembly of claim 17, wherein the electric contact is configured as a crimp, an electrical, or an ultrasonic welding contact.

21. The electric contact of claim 2, wherein each of the plurality of contact springs has a free end, the free ends of the plurality of contact springs arranged in a straight line parallel to an edge of the counter-contact.

22. An electric contact, comprising:

an electric contact section having a plurality of contact springs with different geometrical shapes mechanically contacting a same counter-contact, at least one contact spring of the plurality of contact springs having a shorter length than another contact spring, a total electric resistivity of a path through each of the plurality of contact springs is equal or approximately equal and is a sum of a respective contact spring electrical resistivity and a corresponding bulk electrical resistivity; and a connecting section connected to an electric conductor, the at least one contact spring having a shorter length positioned closer to the connecting section.

23. The electric contact of claim 22, wherein the plurality of contact springs is positioned in an intermeshing arrangement.

24. The electric contact of claim 22, wherein the electric contact section further comprises a contact body to which the plurality of contact springs are attached.

25. The electric contact of claim 24, wherein the contact body accepts the counter-contact in a plurality of directions.

26. The electric contact of claim 25, wherein the plurality of contact springs is arranged in opposite layers of the contact body.

27. The electric contact of claim 26, wherein each layer has two intermeshed arrays of contact springs.

28. The electric contact of claim 27, wherein an intermeshed array of one layer is flush with an intermeshed array of the opposite layer.

29. The electric contact of claim 28, wherein an intermeshed array has at least three contact springs.

30. The electric contact of claim 29, wherein one side of an intermeshed array has one more contact spring than the other side of the intermeshed array.

31. The electric contact of claim 22, wherein at least one contact spring is configured as a contact lamella.

* * * * *